US009566629B2

(12) United States Patent
Lin et al.

(10) Patent No.: US 9,566,629 B2
(45) Date of Patent: Feb. 14, 2017

(54) MOLD FOR MOLDING A CASE OF A MOBILE DEVICE

(71) Applicant: ASIA VITAL COMPONENTS CO., LTD., New Taipei (TW)

(72) Inventors: Kuo-Sheng Lin, New Taipei (TW); Fei-Fei Shi, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 97 days.

(21) Appl. No.: 14/718,219

(22) Filed: May 21, 2015

(65) Prior Publication Data

US 2016/0339496 A1 Nov. 24, 2016

(51) Int. Cl.

| | |
|---|---|
| ***B21D 22/02*** | (2006.01) |
| ***B21D 37/10*** | (2006.01) |
| *B21D 37/14* | (2006.01) |
| *B21J 13/02* | (2006.01) |

(52) U.S. Cl.

CPC ..... *B21D 22/02* (2013.01); *B21D 37/10* (2013.01); *B21D 37/14* (2013.01); *B21J 13/02* (2013.01)

(58) Field of Classification Search

CPC ..... B21D 22/02; B21D 22/06; B21D 37/10; B21D 37/14; B30B 15/02; B21J 5/02; B21J 13/02; B21J 13/025; B22D 17/22; B22D 33/04

USPC ..... 72/352, 353.2, 353.4, 353.6, 354.2, 357,72/394, 402, 348; 164/137, 339, 342; 249/155, 249/158; 425/542, 595

See application file for complete search history.

*Primary Examiner* — A. Dexter Tugbang
*Assistant Examiner* — Joshua D Anderson

(57) ABSTRACT

A mold for molding a case of a mobile device includes a first, second, third, fourth and fifth main body, connection slide blocks, and first and second abutment slide blocks. The connection slide blocks and the second abutment slide blocks are inlaid in first and second slide channels of the first and second main bodies. The first abutment slide blocks are inlaid in channels of the connection slide blocks. The third, fourth and fifth main bodies are horizontally movable relative to the first and second main bodies. The first and second main bodies, the connection slide blocks and the first and second abutment slide blocks together define a male mold section and the third, fourth and fifth main bodies together define a female mold section. A metal thin sheet is placed on the male mold section and pressurized and molded by the female mold section to form the case.

5 Claims, 4 Drawing Sheets

MOLD FOR MOLDING A CASE OF A MOBILE DEVICE

BACKGROUND OF THE INVENTION

1. Field of the Invention

The present invention relates generally to a mold for molding a case of a mobile device, and more particularly to a mold for molding and manufacturing a case of a mobile device.

2. Description of the Related Art

Currently, the mobile devices such as handheld mobile phones, tablets and other 3C products have higher and higher operation performance. As a result, along with the promotion of the operation performance, the heat generated by the internal chips of the mobile device is continuously increased. No matter whether a vapor chamber or a heat pipe or a graphite plate is used to transfer the heat, the heat must be transferred to outer side of the device to dissipate. In order to stress the appearance and sense of quality or provide novel style, some mobile device manufacturers often selectively manufacture the case of the handheld device from plastic or other nonmetal material.

Through some tests, it is proved that the metal-made case of the handheld device still has better heat dissipation effect. To manufacture a metal-made handheld device case, a CNC processing apparatus is mainly used to cut and process metal blocks so as to achieve a thin metal case body. When using a CNC processing apparatus to cut or mill and process the metal block, the CNC processing apparatus removes the unneeded parts of the material to achieve the product. It is quite time-consuming to cut and process the material so that the manufacturing time is prolonged to lead to increase of cost. Moreover, the selection of the cutting blade and the wear of the cutting blade are also great problems in consideration of processing cost.

Furthermore, the purchase of the CNC processing apparatus is the major cost in the manufacturing. This is because the multiaxial CNC processing apparatus is much more expensive than other CNC processing apparatuses. In addition, the operator must have the ability to draft the processing program and know how to operate the CNC processing apparatus. Therefore, the cost for training the operator is another issue that should be taken into consideration. The multiaxial CNC processing apparatus is quite sophisticated and complicated. Therefore, the service and maintenance cost for the multiaxial CNC processing apparatus is also very high.

Also, when using the CNC processing apparatus to cut and process the material, it is necessary to use a great amount of cutting fluid to lower the temperature. Some kinds of cutting fluids cannot be recovered and recycled. As a result, the cutting fluids will lead to pollution of the environment.

It is therefore tried by the applicant to improve the manufacturing process of the handheld device case so as to lower the manufacturing cost.

Some other manufacturers try to manufacture the handheld device case by punching. However, with respect to a relatively complicated structure such as a structure with a round corner or arched or curved face, it often takes place that the material cannot be de-molded to achieve the product. This problem needs to be overcome.

At the present stage, the mainstream of the manufacturing process of the handheld device case is still to manufacture the handheld device case from plastic material by injection molding or use the CNC processing apparatus to process the metal case. However, the manufacturing process still needs to be improved so as to achieve a metal case with both good sense of quality and better heat dissipation effect at much lower manufacturing cost.

SUMMARY OF THE INVENTION

It is therefore a primary object of the present invention to provide a mold for molding a case of a mobile device. By means of the mold, the case of the mobile device can be manufactured by molding.

It is a further object of the present invention to provide the above mold for molding a case of a mobile device, which can manufacture the case of the mobile device at lower manufacturing cost.

To achieve the above and other objects, the mold for molding a case of a mobile device of the present invention includes a first main body, a second main body, multiple connection slide blocks, a third main body, a fourth main body, a fifth main body, multiple first abutment slide blocks and multiple second abutment slide blocks.

The first main body has an upper side and a lower side. A periphery of the first main body has multiple first slide channels. The second main body is correspondingly disposed under a lower side of the first main body. Multiple second slide channels are formed on four corners of the second main body and correspondingly extend to four corners of the first main body. The connection slide blocks are respectively correspondingly inlaid in the second slide channels and slidable relative to the first and second main bodies. Each connection slide block has a channel. The third main body is correspondingly disposed on right side of the first main body and horizontally movable relative to the first main body. The third main body has a first arched recess on one side adjacent to the first main body. The fourth main body is correspondingly disposed on left side of the first main body and horizontally movable relative to the first main body. The fourth main body has a second arched recess on one side adjacent to the first main body. The fifth main body is correspondingly disposed on front side of the first main body and horizontally movable relative to the first main body. The fifth main body has a third arched recess on one side adjacent to the first main body. The first abutment slide blocks are respectively correspondingly inlaid in the channels and slidable relative to the first and second main bodies. The second abutment slide blocks are respectively correspondingly inlaid in the first slide channels. The first and second main bodies and the connection slide blocks and the first and second abutment slide blocks together define a male mold section. The third, fourth and fifth main bodies together define a female mold section. The male and female mold sections are connectable with each other to form a mold cavity.

By the conventional technique, it is impossible to manufacture a metal mobile device case by molding. The mold for molding a case of a mobile device of the present invention overcomes the shortcoming of the conventional technique. By means of the mold for molding a case of a mobile device of the present invention, a metal mobile device case can be manufactured by molding. Moreover, the mold can be used to manufacture the mobile device case at much lower manufacturing cost.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
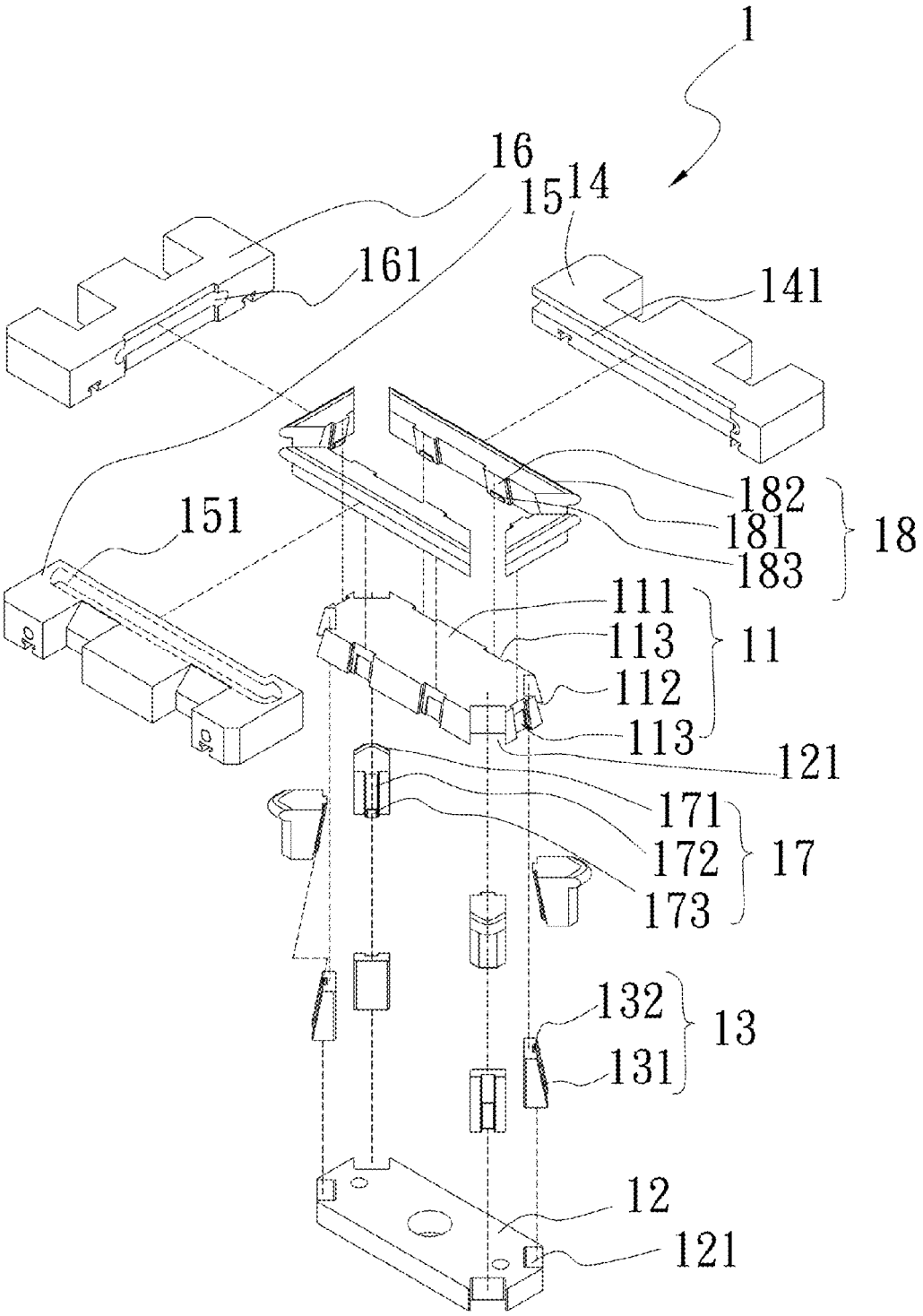
FIG. 1 is a perspective exploded view of a first embodiment of the mold for molding a case of a mobile device of the present invention.
Figure 2:
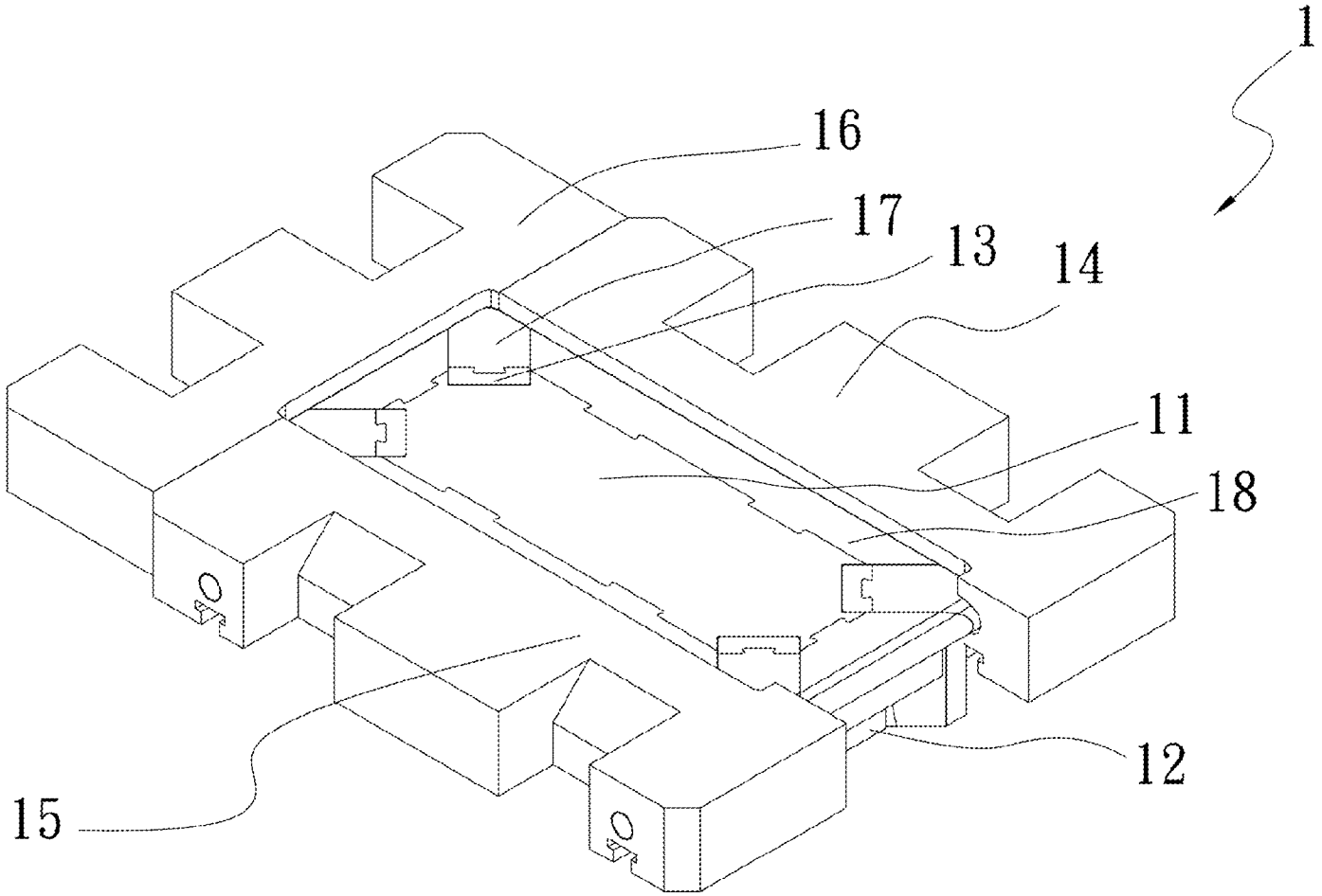
FIG. 2 is a perspective assembled view of the first embodiment of the mold for molding a case of a mobile device of the present invention.
Figure 2A:
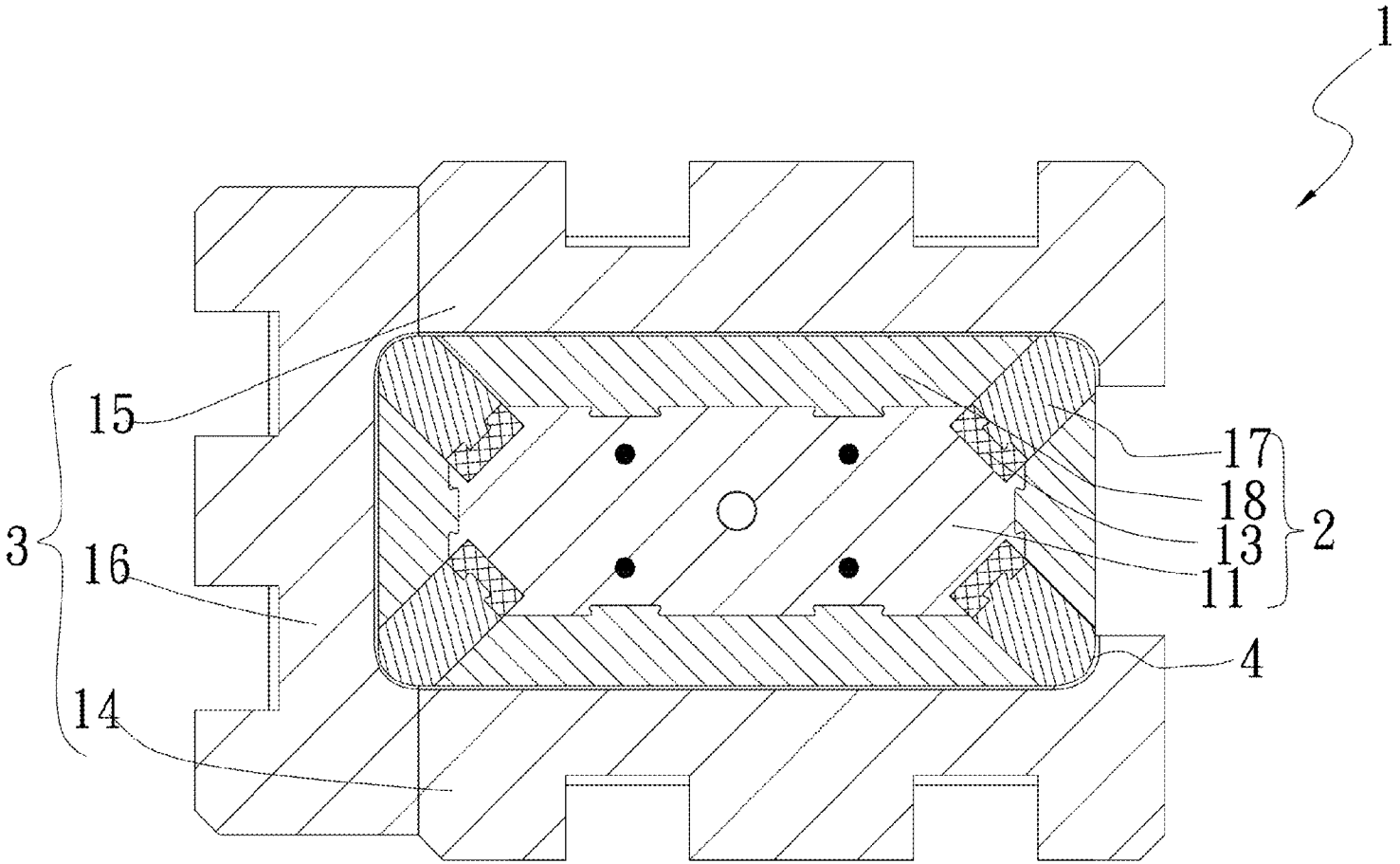
FIG. 2A is a sectional assembled view of the first embodiment of the mold for molding a case of a mobile device of the present invention.

Please refer to FIGS. 1, 2 and 2A. FIG. 1 is a perspective exploded view of a first embodiment of the mold for molding a case of a mobile device of the present invention. FIG. 2 is a perspective assembled view of the first embodiment of the mold for molding a case of a mobile device of the present invention. FIG. 2A is a sectional assembled view of the first embodiment of the mold for molding a case of a mobile device of the present invention. According to the first embodiment, the mold 1 for molding a case of a mobile device of the present invention includes a first main body 11, a second main body 12, multiple connection slide blocks 13, a third main body 14, a fourth main body 15, a fifth main body 16, multiple first abutment slide blocks 17 and multiple second abutment slide blocks 18.

The first main body 11 has an upper side 111 and a lower side 112. The periphery of the first main body 11 has multiple first slide channels 113. The first slide channels 113 are respectively formed on left and right sides and front and rear sides of the first main body 11.

The second main body 12 is correspondingly disposed under the lower side of the first main body 11. The periphery of the second main body 12 has multiple second slide channels 121. The second slide channels 121 are formed on four corners of the second main body 12 and extend to four corners of the first main body 11 corresponding to the four corners of the second main body 12. The first main body 11 is a trapezoid hexahedron body. Due to the trapezoid hexahedron form of the first main body 11, the first slide channels 113 formed on the periphery, (that is, the left, right, front and rear sides) of the main body 11 are inclined from the first main body 11.

The connection slide blocks 13 are respectively correspondingly inlaid in the second slide channels 121 and slidable relative to the first and second main bodies 11, 12. Each connection slide block 13 has the form of a rectangular triangular hexahedron body. The connection slide block 13 has a hypotenuse 131 on which a channel 132 is formed.

The third main body 14 is correspondingly disposed on the right side of the first main body 11 and horizontally movable relative to the first main body 11 (toward or away from the first main body 11). The third main body 14 has a first arched recess 141 on one side adjacent to the first main body 11.

The fourth main body 15 is correspondingly disposed on the left side of the first main body 11 and horizontally movable relative to the first main body 11 (toward or away from the first main body 11). The fourth main body 15 has a second arched recess 151 on one side adjacent to the first main body 11.

The fifth main body 16 is correspondingly disposed on the front side of the first main body 11 and horizontally movable relative to the first main body 11 (toward or away from the first main body 11). The fifth main body 16 has a third arched recess 161 on one side adjacent to the first main body 11.

The first abutment slide blocks 17 are respectively correspondingly inlaid in the channels 132 and slidable relative to the first and second main bodies 11, 12. The channels 132 are formed on the hypotenuses 131 of the connection slide blocks 13 so that the first abutment slide blocks 17 are obliquely slidable relative to the first and second main bodies 11, 12. Each first abutment slide block 17 has an abutment section 171 and an insertion section 172 respectively disposed on outer edge and inner edge of the first abutment slide block 17. The insertion section 172 has a restriction protrusion block 173 near bottom side of the first abutment slide block 17. The abutment section 171 on outer edge of the first abutment slide block 17 has the form of a convex face.

The second abutment slide blocks 18 are respectively correspondingly inlaid in the first slide channels 113 of the first main body 11. Each second abutment slide block 18 has an abutment section 181 and an insertion slide section 182 respectively disposed on outer edge and inner edge of the second abutment slide block 18. The insertion slide section 182 has a restriction protrusion section 183 near bottom side of the second abutment slide block 18. The abutment section 181 on outer edge of the second abutment slide block 18 has the form of a convex face.

The abutment sections 171, 181 of the first and second abutment slide blocks 17, 18 in the form of a convex face correspond to the first, second and third arched recesses 141, 151, 161 of the third, fourth and fifth main bodies 14, 15, 16.

The first and second main bodies 11, 12 and the connection slide blocks 13 and the first and second abutment slide blocks 17, 18 together define a male mold section 2. The third, fourth and fifth main bodies 14, 15, 16 together define a female mold section 3. When the top sides of the connection slide blocks 13 and the first and second abutment slide blocks 17, 18 are flush with the upper side 111 of the first main body 11, the shape of the male mold section 2 is formed. When the female mold section 3 together defined by the third, fourth and fifth main bodies 14, 15, 16 horizontally moves to get close to the male mold section 2, a mold cavity 4 is formed.

Figure 3:
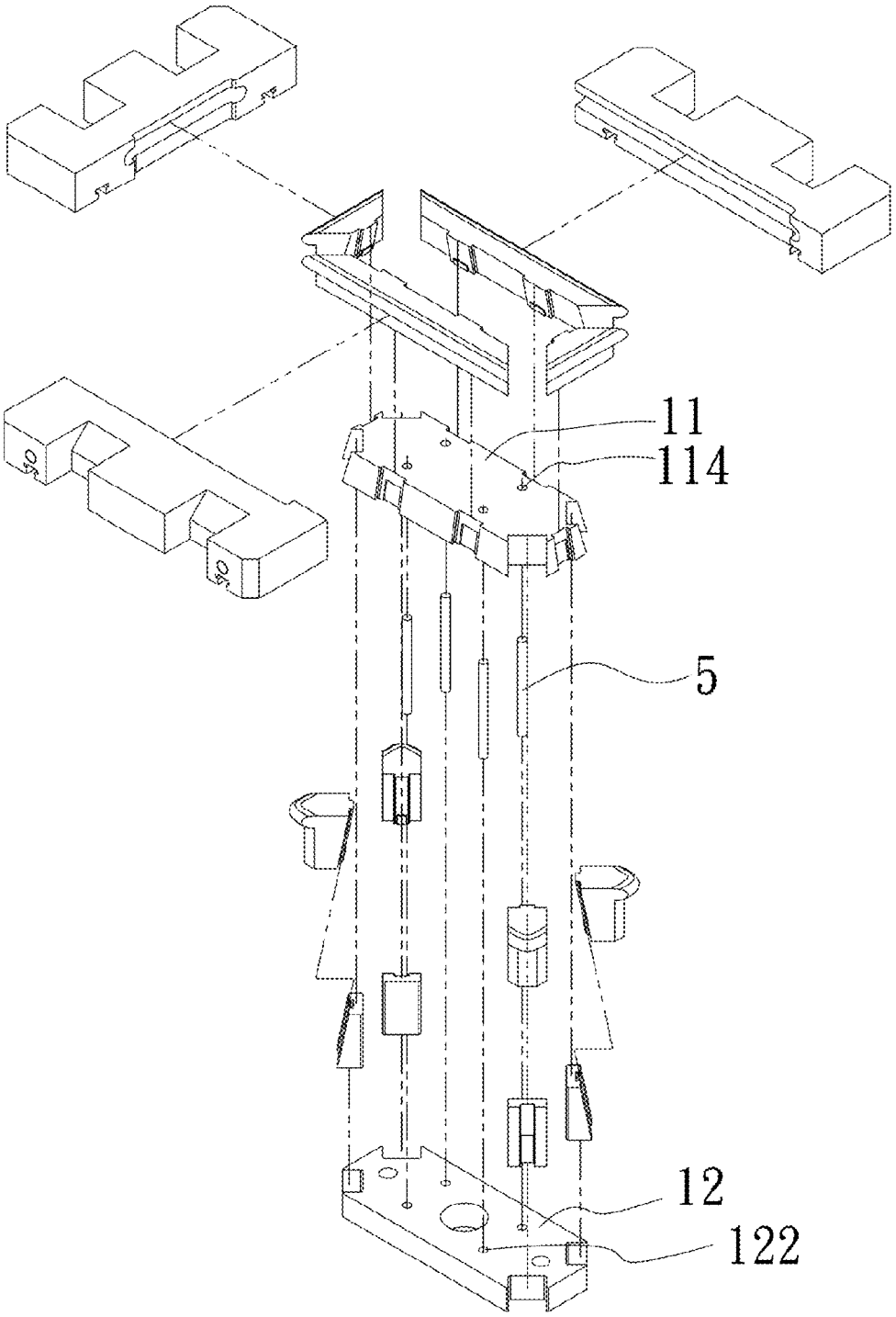
FIG. 3 is a perspective exploded view of a second embodiment of the mold for molding a case of a mobile device of the present invention.

Please now refer to FIG. 3, which is a perspective exploded view of a second embodiment of the mold for molding a case of a mobile device of the present invention. As shown in FIG. 3, the second embodiment is partially identical to the first embodiment in structure and thus will not be repeatedly described hereinafter. The second embodiment is different from the first embodiment in that the first and second main bodies 11, 12 further have multiple through holes 114, 122 and multiple push pins 5. The through holes 114, 122 are positioned in alignment with each other. The push pins 5 are respectively correspondingly fitted in the through holes 114, 122 of the first and second main bodies 11, 12 and up and down movable relative to the first and second main bodies 11, 12. The push pins 5 serve to help in separating a work piece from the surface of the first main body 11 in demolding process.

The present invention has been described with the above embodiments thereof and it is understood that many changes and modifications in the above embodiments can be carried out without departing from the scope and the spirit of the invention that is intended to be limited only by the appended claims.

What is claimed is:

1. A mold for molding a case of a mobile device, comprising:

a first main body having an upper side and a lower side, a periphery of the first main body having multiple first slide channels;

a second main body correspondingly disposed under the lower side of the first main body, multiple second slide channels being formed on four corners of the second main body and correspondingly extending to four corners of the first main body;

multiple connection slide blocks respectively correspondingly inlaid in the second slide channels and slidable relative to the first and second main bodies, each connection slide block having a channel;

a third main body correspondingly disposed on a right side of the first main body and horizontally movable relative to the first main body, the third main body having a first arched recess on one side adjacent to the first main body;

a fourth main body correspondingly disposed on a left side of the first main body and horizontally movable relative to the first main body, the fourth main body having a second arched recess on one side adjacent to the first main body;

a fifth main body correspondingly disposed on a front side of the first main body and horizontally movable relative to the first main body, the fifth main body having a third arched recess on one side adjacent to the first main body;

multiple first abutment slide blocks respectively correspondingly inlaid in the channels of the multiple connection slide blocks and slidable relative to the first and second main bodies;

multiple second abutment slide blocks respectively correspondingly inlaid in the first slide channels, the first and second main bodies and the connection slide blocks and the first and second abutment slide blocks together defining a male mold section, the third, fourth and fifth main bodies together defining a female mold section, the male and female mold sections being connectable with each other to form a mold cavity.

2. The mold for molding a case of a mobile device as claimed in claim 1, wherein the first and second main bodies further have multiple through holes and multiple push pins, the through holes being positioned in alignment with each other, the push pins being respectively correspondingly fitted in the through holes of the first and second main bodies.

3. The mold for molding a case of a mobile device as claimed in claim 1, wherein each connection slide block has the form of a rectangular triangular hexahedron body.

4. The mold for molding a case of a mobile device as claimed in claim 1, wherein the first main body is a trapezoid hexahedron body.

5. The mold for molding a case of a mobile device as claimed in claim 1, wherein each first abutment slide block has an abutment section and an insertion section respectively disposed on outer edge and inner edge of the first abutment slide block, the insertion section having a restriction protrusion block near a bottom side of the first abutment slide block, the abutment section on an outer edge of the first abutment slide block having the form of a convex face, the second abutment slide blocks being respectively correspondingly inlaid in the first slide channels of the first main body, each second abutment slide block having an abutment section and an insertion slide section respectively disposed on outer edge and inner edge of the second abutment slide block, the insertion slide section having a restriction protrusion section near a bottom side of the second abutment slide block, the abutment section on an outer edge of the second abutment slide block having the form of a convex face, the abutment sections of the first and second abutment slide blocks corresponding to the first, second and third arched recesses of the third, fourth and fifth main bodies.

* * * * *